US011217095B2

(12) United States Patent
Kreutzer et al.

(10) Patent No.: US 11,217,095 B2
(45) Date of Patent: Jan. 4, 2022

(54) VEHICLE MOUNTED TRAFFIC CONTROL APPARATUS

(71) Applicants: Kimberlin Kirk Kreutzer, Watrous (CA); Donna Faye Marie Kreutzer, Watrous (CA)

(72) Inventors: Kimberlin Kirk Kreutzer, Watrous (CA); Donna Faye Marie Kreutzer, Watrous (CA)

( * ) Notice: Subject to any disclaimer, the term of this patent is extended or adjusted under 35 U.S.C. 154(b) by 0 days.

(21) Appl. No.: 16/534,744

(22) Filed: Aug. 7, 2019

(65) Prior Publication Data

US 2021/0043080 A1 Feb. 11, 2021

(51) Int. Cl.

| | |
|---|---|
| ***G08G 1/095*** | (2006.01) |
| ***G08G 1/0955*** | (2006.01) |
| ***G08G 1/07*** | (2006.01) |
| ***E01F 9/662*** | (2016.01) |
| ***E01F 9/65*** | (2016.01) |
| ***E01F 9/646*** | (2016.01) |

(52) U.S. Cl.

CPC ..... *G08G 1/0955* (2013.01); *E01F 9/646* (2016.02); *E01F 9/65* (2016.02); *E01F 9/662* (2016.02); *G08G 1/07* (2013.01)

(58) Field of Classification Search

CPC ..... G08G 1/0955; G08G 1/07; E01F 9/646; E01F 9/65; E01F 9/662

USPC ..... 340/908

See application file for complete search history.

(56) References Cited

U.S. PATENT DOCUMENTS

| | | | | |
|---|---|---|---|---|
| 3,741,147 | A * | 6/1973 | Downing | G09F 11/06 116/63 R |
| 4,087,785 | A * | 5/1978 | Dodich | B60Q 1/305 254/387 |
| 5,422,638 | A * | 6/1995 | Singer | G08G 1/095 116/63 P |
| 5,475,386 | A * | 12/1995 | Luoma | G08G 1/0955 116/63 P |
| 6,693,556 | B1 * | 2/2004 | Jones | G08G 1/095 340/815.45 |
| 6,956,502 | B1 * | 10/2005 | Bartinelli | G08G 1/095 340/907 |
| 8,164,483 | B1 * | 4/2012 | Phillips | E01F 9/646 340/908 |
| 9,245,465 | B1 * | 1/2016 | Geyer | B60Q 1/2692 |
| 10,513,219 | B1 * | 12/2019 | Hassler | B60D 1/58 |
| 10,592,916 | B1 * | 3/2020 | DeLorean | G08G 1/052 |

(Continued)

*Primary Examiner* — Zhen Y Wu

(74) *Attorney, Agent, or Firm* — Capehart Law Firm

(57) ABSTRACT

A traffic control signal apparatus that is configured to be releasably secured to a hitch receiver on a vehicle wherein the traffic control signal apparatus is operable to provide traffic signals to approaching vehicles. The present invention includes a frame having an upper portion and a lower portion wherein the lower portion is coupled to the vehicle. The upper portion has a light unit secured thereto and the light unit includes a first light and a second light configured to illuminate colors providing approaching vehicles traffic signals. A sign support member is movably secured to the frame and includes a sign secured to the end distal to the frame. A sign is secured to the distal end of the sign support member and is configured to provide traffic instructions to approaching vehicles. The traffic control signal is electrically coupled to the vehicle and includes a control panel for operation.

13 Claims, 1 Drawing Sheet

(56) References Cited

U.S. PATENT DOCUMENTS

| | | | | |
|---|---|---|---|---|
| 2003/0213153 | A1* | 11/2003 | Kim | G09F 15/0037 40/607.14 |
| 2005/0210722 | A1* | 9/2005 | Graef | G09F 9/33 40/452 |
| 2006/0055558 | A1* | 3/2006 | Rohl | G08G 1/0955 340/907 |
| 2006/0218835 | A1* | 10/2006 | Chafin | G09F 21/04 40/611.05 |
| 2008/0198038 | A1* | 8/2008 | Yingst | G08G 1/0955 340/908 |
| 2010/0319229 | A1* | 12/2010 | McCoy | G09F 7/22 40/606.01 |
| 2011/0012751 | A1* | 1/2011 | Jones | H04L 67/125 340/12.54 |
| 2011/0205085 | A1* | 8/2011 | Legare | E01F 9/662 340/908 |
| 2014/0240139 | A1* | 8/2014 | Tapley | G09B 21/04 340/815.4 |
| 2015/0023009 | A1* | 1/2015 | White | E01F 9/662 362/183 |
| 2016/0264043 | A1* | 9/2016 | Schloesser | B60Q 1/525 |
| 2017/0154524 | A1* | 6/2017 | Beaulieu | H04W 4/023 |
| 2018/0144628 | A1* | 5/2018 | Nicholson | G08G 1/0955 |
| 2018/0212976 | A1* | 7/2018 | Arunkumar | H04L 63/107 |
| 2019/0330811 | A1* | 10/2019 | Roy | B60Q 7/02 |

* cited by examiner

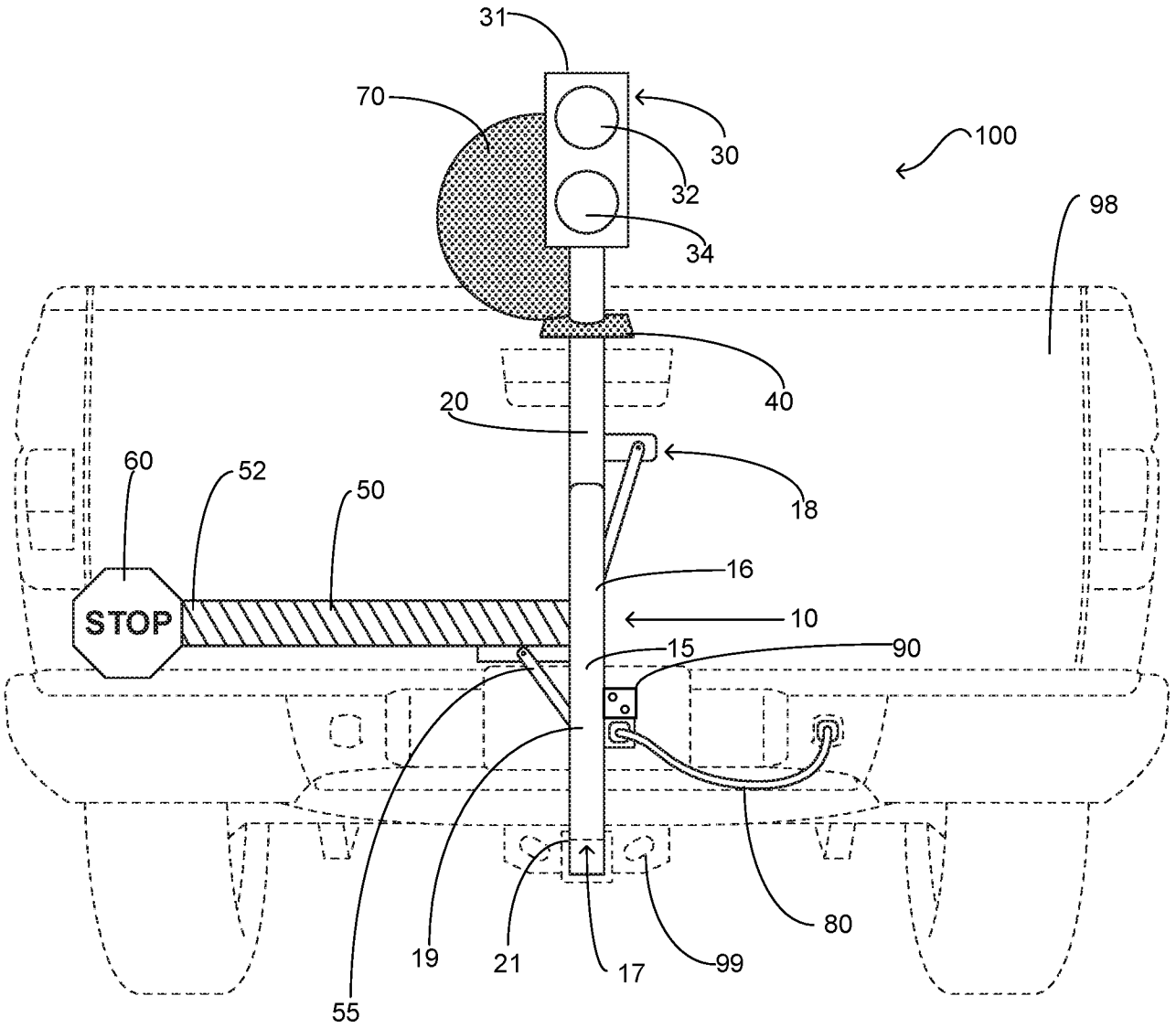
100
98
30
32
34
31
70
40
20
18
16
10
90
15
80
99
17
21
19
55
50
52
60
STOP

VEHICLE MOUNTED TRAFFIC CONTROL APPARATUS

FIELD OF THE INVENTION

The present invention relates generally to traffic control devices, more specifically but not by way of limitation, a traffic control device for use at temporary locations such as but not limited to road construction areas, wherein the present invention is operably coupled to a vehicle and configured to be operated from a remote location.

BACKGROUND

Roadway construction is prevalent in most major cities and routinely can be a cause of traffic congestion. Billions of dollars are spent every year on road improvement projects or expansion initiatives. Roadway projects vary in size and scope but many roadway construction projects must implement a traffic control plan as part of the project implementation. It is often that roadway construction can either reduce or eliminate traffic lanes in one or both directions. In order to minimize congestion and potential accidents roadway construction companies typically deploy labor that are responsible for controlling traffic during the construction process. By way of example but not limitation, some roadway construction projects may reduce a road to one lane and thus require control of traffic thereon. Commonly, individuals are deployed at opposing ends of the available lane and use conventional signs to instruct oncoming drivers what action to take, which often involves yielding to oncoming traffic and then a subsequent switch of traffic flow will be regulated by the construction workers. In addition to construction traffic control, incidents such as but not limited to car accidents and other emergencies can often impact the availability of roadway lanes and require temporary direction of traffic.

One safety concern for the aforementioned is the proximity of the workers to the passing vehicles. Whether an emergency worker or a roadway construction worker, these individuals can be within yards of passing traffic placing these individuals at risk. Utilization of conventional handheld signs is common and as such precipitates the requirement for individuals to be proximate the roadway lanes. Distracted drivers place these individuals at a high risk given the proximity at which the workers are located to the roadway lanes.

Accordingly, there is a need for a traffic control apparatus that can be remotely operated wherein the traffic control apparatus is configured to be operably coupled to a vehicle wherein the vehicle is placed in a required location to facilitate the necessary traffic control at locations such as but not limited to roadway construction.

SUMMARY OF THE INVENTION

It is the object of the present invention to provide a traffic control apparatus that is configured to provide traffic control at a location such as but not limited to roadway construction wherein the traffic control apparatus is configured to be operably coupled to a vehicle.

Another object of the present invention is to provide a temporary traffic control apparatus operable to provide traffic signals to vehicles traversing through an area such as but not limited to an accident scene or roadway construction wherein the traffic control apparatus includes a frame manufactured from a rigid material.

A further object of the present invention is to provide a traffic control apparatus that is configured to provide traffic control at a location such as but not limited to roadway construction wherein the frame includes an upper portion and a lower portion that are hingedly coupled.

Still another object of the present invention is to provide a temporary traffic control apparatus operable to provide traffic signals to vehicles traversing through an area such as but not limited to an accident scene or roadway construction wherein the lower portion of the frame is mechanically coupled to a vehicle.

An additional object of the present invention is to provide a traffic control apparatus that is configured to provide traffic control at a location such as but not limited to roadway construction wherein the upper portion of the frame further includes a light unit secured to the end thereof distal to the lower portion.

Yet a further object of the present invention is to provide a temporary traffic control apparatus operable to provide traffic signals to vehicles traversing through an area such as but not limited to an accident scene or roadway construction that further includes a sign support member movably coupled to the frame.

Another object of the present invention is to a provide a traffic control apparatus that is configured to provide traffic control at a location such as but not limited to roadway construction wherein the sign support member is movable intermediate a first position and a second position.

An alternate object of the present invention is to provide a temporary traffic control apparatus operable to provide traffic signals to vehicles traversing through an area such as but not limited to an accident scene or roadway construction wherein the temporary traffic control apparatus is electrically coupled to the vehicle to which it is secured.

Still a further object of the present invention is to provide a traffic control apparatus that is configured to provide traffic control at a location such as but not limited to roadway construction wherein the present invention is configured to be operated remotely.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

FIG. 1 is perspective view of the present invention mounted to an exemplary vehicle; and

DETAILED DESCRIPTION

Referring now to the drawings submitted herewith, wherein various elements depicted therein are not necessarily drawn to scale and wherein through the views and figures like elements are referenced with identical reference numerals, there is illustrated a traffic control apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the traffic control apparatus 100 includes a frame 10. The frame 10 is manufactured from a suitable rigid material such as but not limited to square metal tubing. The frame 10 includes a lower portion 15 and upper portion 20 that are hingedly secured via hinge assembly 18. The lower portion 15 includes an upper section 16 and lower section 17 that are integrally formed wherein the lower portion 15 includes arcuate shaped section 19. The lower portion 17 includes end 21 that is configured to be operably coupled into a hitch receiver on a vehicle. In the preferred embodiment the lower portion 15 is configured to be operably coupled to a hitch receiver 99 of a vehicle 98 and extend outward therefrom so as to provide desired positioning at a required location for the traffic control apparatus 100. However, it is further contemplated within the scope of the present invention that the traffic control apparatus 100 could be mounted to an exemplary vehicle utilizing alternate techniques. While the lower portion 15 is formed herein having arcuate section 19, it is contemplated within the scope of the present invention that the lower portion 15 could be formed in alternate shapes so as so as to achieve the desired objective of positioning the frame 10 outward from the exemplary vehicle.

The upper portion 20 is hingedly secured to lower portion 15 utilizing hinge assembly 18. Hinge assembly 18 facilitates the movement of the upper portion 20 intermediate a first position and a second position. In its first position, the upper portion 20 of the frame 10 is adjacent the lower portion 15 so as to provide a size for the frame 10 more suitable for travel. In the second position, as particularly illustrated herein, the upper portion 20 is axially aligned with the upper section 16 of the lower portion 15 and extends upward therefrom. Secured to the upper portion 20 distal to the lower portion 15 is a first light unit 30. The first light unit 30 includes a first light 32 and second light 34 enclosed in a weather proof housing 31. In a preferred embodiment the first light 32 is red in color and the second light 34 is amber or yellow in color. The aforementioned colors are preferred as these lights are known colors utilized for traffic control. It is contemplated within the scope of the present invention that the first light 32 and second light 34 could be alternate colors. It is further contemplated within the scope of the present invention that the first light 32 and second light 34 could be operated in various illumination patterns such as but not limited to continuous and/or flashing. While the frame 10 has been disclosed herein in a preferred embodiment, it is contemplated within the scope of the present invention that the frame 10 could be manufactured in alternate styles and still achieve the desired functionality as described herein. While the first light unit 30 is illustrated herein in its preferred embodiment having a first light 32 and second light 34, it is contemplated within the scope of the present invention that the light unit 30 could have more or less than two lights.

Adjacent to the first light unit 30 and located therebeneath is the second light unit 40. The second light unit 40 is configured to provide light to the area adjacent to the location of the traffic control apparatus 100. The second light unit 40 in a preferred embodiment is a conventional spotlight/floodlight and is operable to assist in operation and visibility of the traffic control apparatus 100 in low light or nighttime conditions. It should be understood within the scope of the present invention that the second light unit 40 could be provide in alternate sizes and illumination strength.

Movably secured to the lower portion 15 of the frame 10 is the sign support member 50. The sign support member 50 is manufactured from a lightweight rigid material and is configured to move intermediate a first position and second position. The sign support member 50 is movably coupled to the frame 10 utilizing hinge 55. Secured to the end 52 of the sign support member 50 is sign 60. Sign 60 is a conventional road sign that is configured to provide directional instructions to an approaching vehicle. It is contemplated within the scope of the present invention that the sign 60 could be manufactured in alternate sizes and shapes and provide various instructions such as but not limited to stop or yield. As illustrated herein, in the second position of the sign support member 50, the sign 60 is in position so as to be viewed by oncoming vehicle traffic. It is contemplated within the scope of the present invention that the sign support member 50 could be manufactured in alternate lengths.

Secured to the upper portion 20 of the frame 10 is sign housing 70. Sign housing 70 is configured to at least partially cover the sign 60 when the sign support member 50 is in its first position. The sign housing 70 is manufactured from a suitable durable material and ensuing the sign support member 50 being moved to its first position will inhibit visibility of the sign 60 to approaching vehicles. The sign housing 70 is mateably shaped with the sign 60 so as to provide at least partial concealment thereof. The sign 60 being movable intermediate the first position and second position, as facilitated by the sign support member, is configured to be operated either with or without the light unit 30.

The traffic control apparatus 100 is electrically coupled to the electrical system of the exemplary vehicle utilizing power cord 80. A conventional twelve-volt direct current supply is desired in the preferred embodiment for the operation of the traffic control apparatus 100. While not particularly illustrated herein, it is contemplated within the scope of the present invention that the traffic control apparatus 100 could employ electric motors to facilitate the movement of the sign support member 50. Furthermore, it is additionally contemplated within the scope of the present invention that the traffic control apparatus 100 could be operated utilizing a remote control (not particularly illustrated herein) to facilitate operation thereof. Remote operation would place an operator of the traffic control apparatus 100 at a safer distance in regards to oncoming traffic in the area in which the traffic control apparatus 100 has been deployed. Control panel 90 is operably coupled to all components of the traffic control apparatus 100 and is further configured with the necessary electronics to store, receive, transmit and manipulate data so as to provide an interface for operational engagement of the traffic control apparatus 100. It should be understood within the scope of the present invention that a remote could be operably coupled to the control panel 90 to provide operation as mentioned herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A traffic control signal apparatus that is configured to be deployed in temporary locations along a roadway, wherein the traffic control signal apparatus comprises:

a frame, said frame having a lower portion and an upper portion, said lower portion and said upper portion being hingedly coupled, said lower portion of said frame being configured to operably couple with a hitch receiver on a vehicle, said lower portion and said upper portion of said frame are perpendicular in orientation;

a light unit, said light unit being mounted to said upper portion of said frame, said light unit having at least one light, said light unit being electrically coupled to the vehicle;

a second light unit, said second light unit configured to provide illumination of an area adjacent to the traffic control signal apparatus;

a sign support member, said sign support member being movably coupled to said frame, said sign support member having a first position and a second position, said sign support member having a first end and a second end, said first end of said sign support member being hingedly secured to said frame; and a sign, said sign being secured to said second end of said sign support member, said sign being configured to provide instructions to approaching drivers;

a sign housing, said sign housing being mounted to said upper portion of said frame, said sign housing configured to at least partially conceal said sign ensuing said sign support member being placed in said first position and to fully expose said sign when said sign support member being placed in said second position.

2. The traffic control signal apparatus as recited in claim 1, wherein said lower portion and said upper portion of said frame are perpendicular in orientation.

3. The traffic control signal apparatus as recited in claim 2, and further including a second light unit, said second light unit configured to provide illumination of an area adjacent to the traffic control signal apparatus.

4. The traffic control signal apparatus as recited in claim 3, and further including a sign housing, said sign housing being mounted to said upper portion of said frame, said sign housing configured to at least partially conceal said sign ensuing said sign support member being placed in said first position.

5. The traffic control signal apparatus as recited in claim 4, wherein the traffic control signal apparatus is electrically coupled to the vehicle.

6. The traffic control signal apparatus as recited in claim 5, and further including a control panel, said control panel being configured to provide operation of the traffic control signal apparatus.

7. The traffic control signal apparatus as recited in claim 6, wherein said lower portion of said frame further includes an arcuate shaped section.

8. A traffic control signal apparatus that is configured to be deployed in temporary locations along a roadway and operably coupled to a vehicle, wherein the traffic control signal apparatus comprises:

a frame, said frame having a lower portion and an upper portion, said lower portion and said upper portion being hingedly coupled, said upper portion of said frame having a first position and a second position, said upper portion being adjacent said lower portion in said first position of said upper portion, said lower portion of said frame being configured to operably couple with a hitch receiver on the vehicle;

a light unit, said light unit being mounted to said upper portion of said frame, said light unit having a first light and a second light, said first light and said second light configured to illuminate different colors;

a sign support member, said sign support member being movably coupled to said frame, said sign support member having a first position and a second position, said sign support member being adjacent said frame in said first position, said sign support member having a first end and a second end, said first end of said sign support member being hingedly secured to said frame;

a sign, said sign being secured to said second end of said sign support member, said sign being configured to provide instructions to approaching drivers; and a sign housing, said sign housing being mounted to said upper portion of said frame proximate said light unit, said sign housing configured to at least partially conceal said sign ensuing said sign support member being placed in said first position and to fully expose said sign when said sign support member being placed in said second position.

9. The traffic control signal apparatus as recited in claim 8, wherein said sign support member is perpendicular to said frame when in said second position.

10. The traffic control signal apparatus as recited in claim 9, and further including a second light unit, said second light unit operable to provide illumination of an area adjacent to the traffic control signal apparatus.

11. The traffic control signal apparatus as recited in claim 10, wherein said upper portion of said frame extends upward from said lower portion of said frame when in said second position.

12. The traffic control signal apparatus as recited in claim 11, and further including a control panel, said control panel being configured to provide operation of the traffic control signal apparatus.

13. The traffic control signal apparatus as recited in claim 12, wherein the traffic control signal apparatus is electrically coupled to the vehicle.

* * * * *